US012201147B2

(12) United States Patent
Yamada et al.

(10) Patent No.: US 12,201,147 B2
(45) Date of Patent: Jan. 21, 2025

(54) INHALATION DEVICE CARTRIDGE AND INHALATION DEVICE EQUIPPED WITH SAME

(71) Applicant: Japan Tobacco Inc., Tokyo (JP)

(72) Inventors: Manabu Yamada, Tokyo (JP); Hirofumi Matsumoto, Tokyo (JP); Yutaka Kaihatsu, Tokyo (JP); Keisuke Morita, Tokyo (JP); Herman Peter Hijma, Zwolle (NL)

(73) Assignee: JAPAN TOBACCO INC., Tokyo (JP)

( * ) Notice: Subject to any disclaimer, the term of this patent is extended or adjusted under 35 U.S.C. 154(b) by 624 days.

(21) Appl. No.: 17/466,586

(22) Filed: Sep. 3, 2021

(65) Prior Publication Data

US 2021/0392950 A1 Dec. 23, 2021

Related U.S. Application Data

(63) Continuation of application No. PCT/JP2019/009308, filed on Mar. 8, 2019.

(51) Int. Cl.

| | |
|---|---|
| ***A24F 40/30*** | (2020.01) |
| ***A24F 40/10*** | (2020.01) |
| ***A24F 40/42*** | (2020.01) |
| ***A24F 40/46*** | (2020.01) |

(52) U.S. Cl.

CPC ..... *A24F 40/10* (2020.01); *A24F 40/42* (2020.01); *A24F 40/46* (2020.01)

(58) Field of Classification Search

None

See application file for complete search history.

(56) References Cited

U.S. PATENT DOCUMENTS

| | | | |
|---|---|---|---|
| 8,528,569 B1 | 9/2013 | Newton | |
| 2014/0261487 A1 | 9/2014 | Chapman et al. | |

(Continued)

FOREIGN PATENT DOCUMENTS

| | | | | |
|---|---|---|---|---|
| CN | 109068735 A | * | 12/2018 | ..... A24F 40/10 |
| KR | 20130092250 A | * | 8/2013 | |

(Continued)

OTHER PUBLICATIONS

KR 20130092250 A, English Translation obtained from Espacenet, pp. 1-21 (Year: 2024).*

(Continued)

*Primary Examiner* — Philip Y Louie
*Assistant Examiner* — John Mitchell Martin
(74) *Attorney, Agent, or Firm* — Birch, Stewart, Kolasch & Birch, LLP

(57) ABSTRACT

An inhalation device cartridge includes a liquid storage portion configured to store liquid, an atomizing portion configured to atomize the liquid, and a flexible liquid transporting member configured to transport the liquid stored in the liquid storage portion toward the atomizing portion. The atomizing portion is a heating element having an elongated shape which includes electrical contact points at both ends and is pressed into a main surface of the liquid transporting member. The pressing depth at a center portion of the heating element is greater than the pressing depth at each end portion of the heating element.

17 Claims, 11 Drawing Sheets

(56) References Cited

U.S. PATENT DOCUMENTS

| | | | | |
|---|---|---|---|---|
| 2015/0144145 | A1* | 5/2015 | Chang | A24F 40/46 131/328 |
| 2017/0188626 | A1* | 7/2017 | Davis | A24F 40/42 |
| 2017/0280773 | A1* | 10/2017 | Force | A24F 40/485 |
| 2018/0333547 | A1* | 11/2018 | Freeman | A24F 40/485 |

FOREIGN PATENT DOCUMENTS

| | | | | |
|---|---|---|---|---|
| WO | WO-2013025585 | A1 * | 2/2013 | A01M 1/2077 |
| WO | WO 2018/117702 | A1 | 8/2015 | |

OTHER PUBLICATIONS

CN 109068735 A, English Translation obtained from Espacenet, pp. 1-18 (Year: 2024).*

Russian Office Action and Search Report for Russian Application No. 2021129183, dated Mar. 11. 2022, with English translation.

International Search Report (PCT/ISA/210) issued in PCT/JP2019/009308, mailed on Jun. 4, 2019.

* cited by examiner

INHALATION DEVICE CARTRIDGE AND INHALATION DEVICE EQUIPPED WITH SAME

CROSS REFERENCE TO RELATED APPLICATIONS

The present application is a continuation application of International Application No. PCT/JP2019/009308, filed on Mar. 8, 2019, which is incorporated herein by reference.

TECHNICAL FIELD

The invention relates to inhalation device cartridges and inhalation devices equipped with same.

BACKGROUND ART

Flavor inhalation devices for inhaling flavors without material burning have been conventionally known. Known as such flavor inhalation devices are, for example, liquid heating-type inhalation devices. The liquid heating-type inhalation devices supply users' mouths with aerosol that is generated by atomizing a flavor-containing aerosol producing material, such as nicotine, or allow aerosol that is generated by atomizing a non-flavor-containing aerosol producing material, such as nicotine, to pass through a flavor source (for example, a tobacco source) and then supply the aerosol to users' mouths.

Some liquid heating-type inhalation devices comprise a tank or a reservoir that stores liquid for generating aerosol, and a heater that atomizes the liquid. Some of such inhalation devices include an atomizer assembly that is formed by winding a coil-shaped heater around a wick that is fluidly connected to a tank (see Patent Literature 1, for example).

Aerosol generation systems are also known in which a mesh-like heater filament is so disposed as to contact a capillary material inserted in a housing of a liquid storage portion (see Patent Literature 2, for example).

CITATION LIST

Patent Literature

PTL 1: U.S. Pat. No. 8,528,569
PTL 2: International Publication No. 2015/117702

SUMMARY OF INVENTION

Technical Problem

An object of the invention is to provide an inhalation device cartridge and an inhalation device which have novel structures.

Solution to Problem

One embodiment of the invention provides an inhalation device cartridge. This inhalation device cartridge comprises a liquid storage portion configured to store liquid, an atomizing portion configured to atomize the liquid, and a flexible liquid transporting member configured to transport the liquid stored in the liquid storage portion toward the atomizing portion. The atomizing portion is a heating element having an elongated shape which includes electrical contact points at both ends and is pressed into a main surface of the liquid transporting member. The pressing depth at a center portion of the heating element is greater than the pressing depth at each end portion of the heating element.

Another embodiment of the invention provides an inhalation device equipped with the above-mentioned inhalation device cartridge.

DESCRIPTION OF EMBODIMENTS

Figure 1:
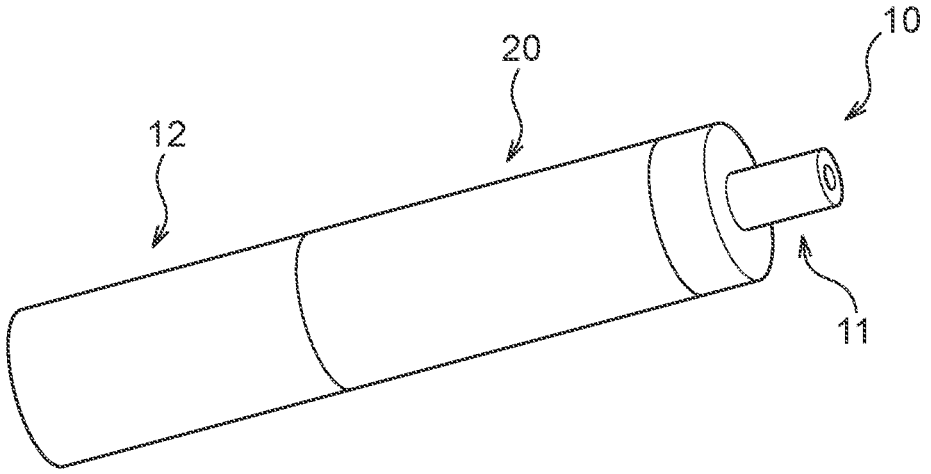
FIG. 1 is a perspective view of an entire inhalation device according to the present embodiment.

Embodiments of the invention will be discussed below with reference to the attached drawings. In the drawings discussed below, similar or corresponding constituent elements are provided with the same reference signs, and overlapping explanations will be omitted.

FIG. 1 is a perspective view of an entire inhalation device according to the present embodiment. As illustrated in FIG. 1, the inhalation device 10 includes a mouthpiece 11, a cartridge 20 (which is an example of an inhalation device cartridge), and a battery portion 12. The cartridge 20 atomizes a liquid containing an aerosol producing material, such as glycerin and propylene glycol, and supplies the atomized aerosol to the mouthpiece 11. The aerosol producing material may contain, for example, nicotine or the like.

The battery portion 12 supplies electric power to the cartridge 20. The mouthpiece 11 guides the aerosol generated in the cartridge 20 to a user's mouth. After the inhalation device 10 is used for a predetermined period of time, the mouthpiece 11 and the cartridge 20 can be replaced. The battery portion 12, however, can be used more than once. It is possible to replace only the cartridge 20 without replacing the mouthpiece 11.

The present embodiment is discussed on the premise that the inhalation device 10 is provided with the cartridge 20 that is replaceable. However, the inhalation device 10 does not have to be thus configured and may be a single-use product fabricated by integrating a component that will be explained below as the cartridge 20 with the battery portion 12. The present embodiment is further discussed on the premise that the inhalation device 10 is provided with the mouthpiece 11. The inhalation device 10, however, does not have to be configured that way. Although, according to the present embodiment, the cartridge 20 and the mouthpiece 11 are configured as separate members, the cartridge 20 and the mouthpiece 11 may be formed integrally.

Figure 2:
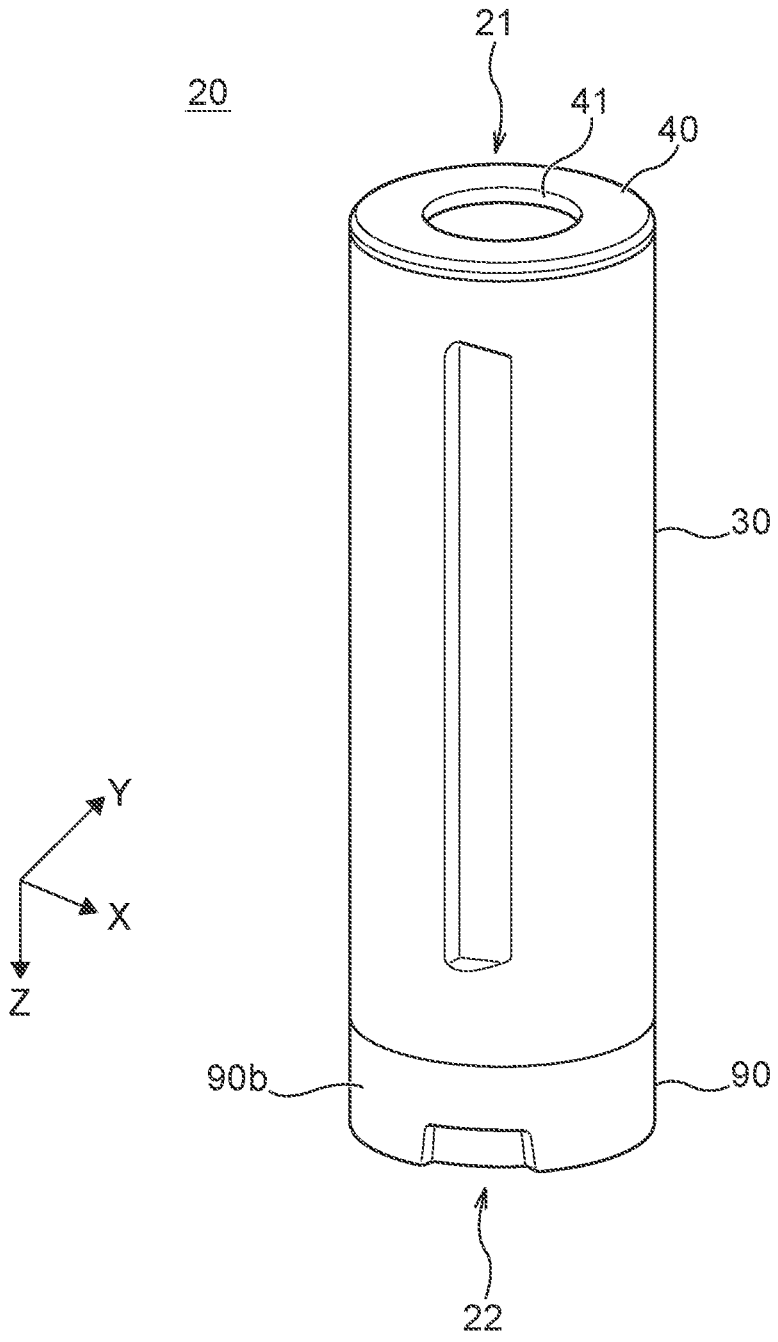
FIG. 2 is a perspective view of a cartridge.
Figure 3:
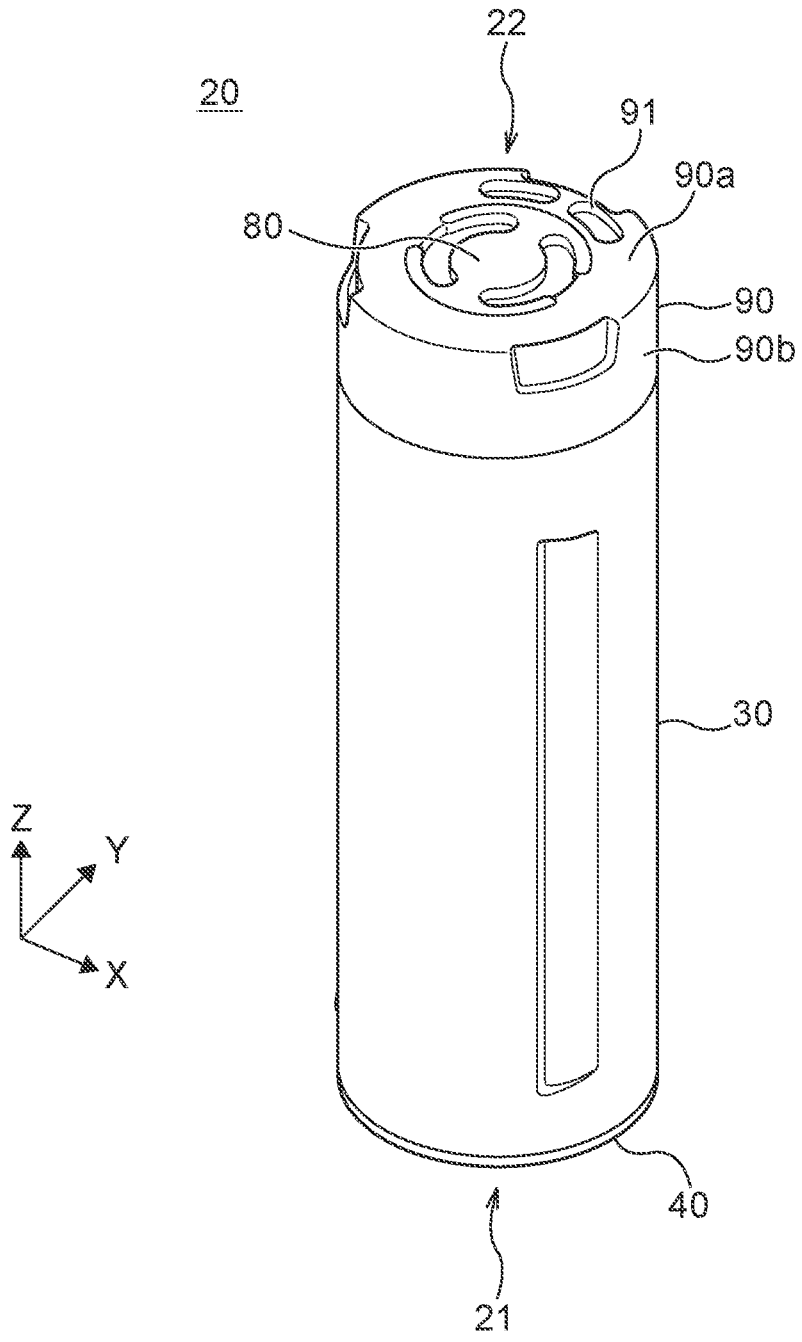
FIG. 3 is a perspective view of the cartridge.
Figure 4:
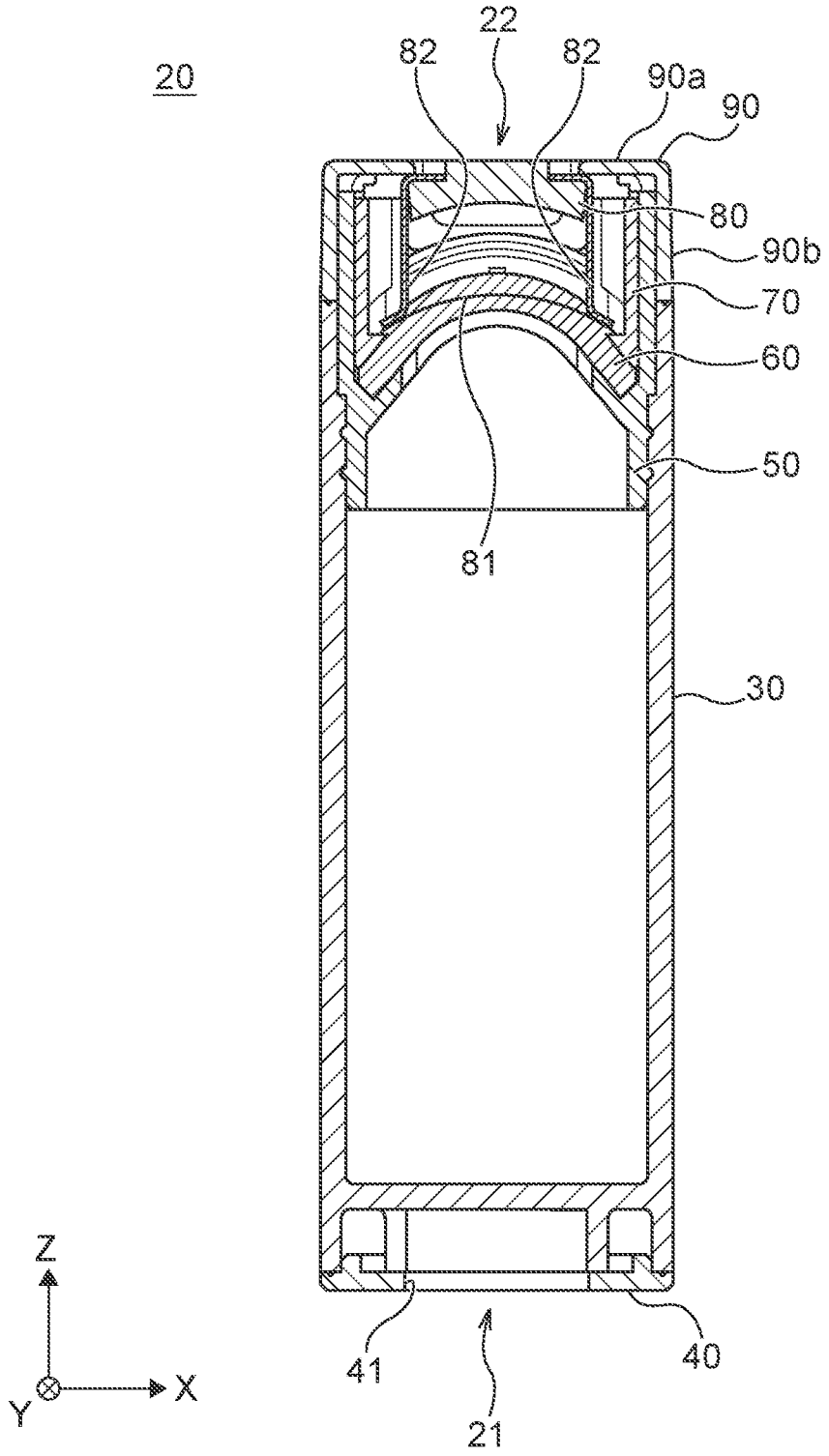
FIG. 4 is a sectional view of the cartridge shown in FIG. 3 taken along an X-axis.
Figure 5:
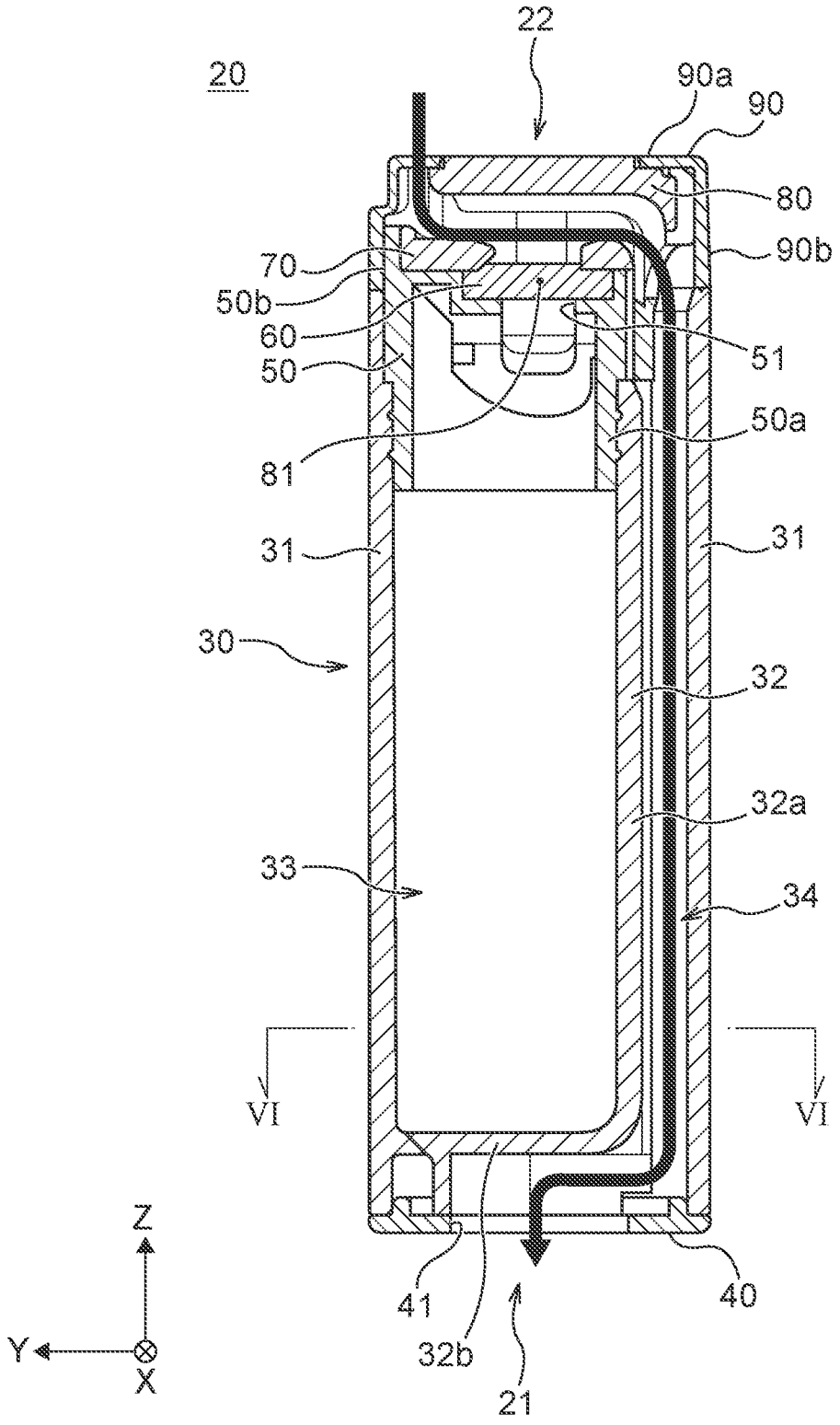
FIG. 5 is a sectional view of the cartridge shown in FIG. 3 taken along a Y-axis.
Figure 6:
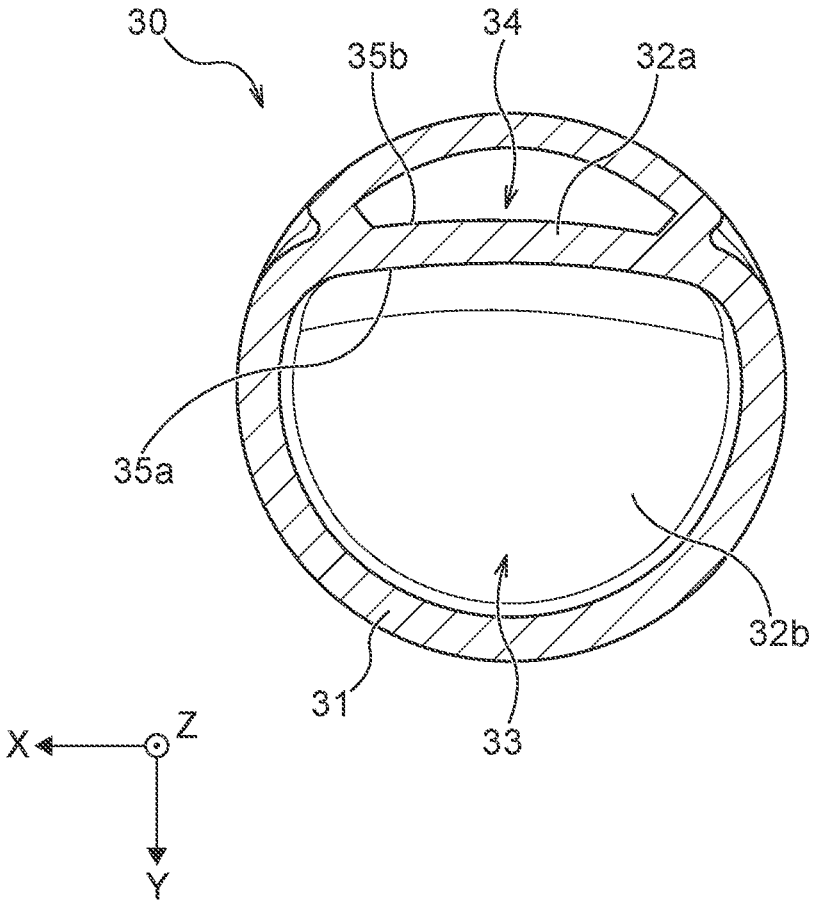
FIG. 6 is a sectional view selectively showing a cartridge body of the cartridge shown in FIG. 5 taken along a VI-VI line as viewed in an arrow direction.
Figure 7:
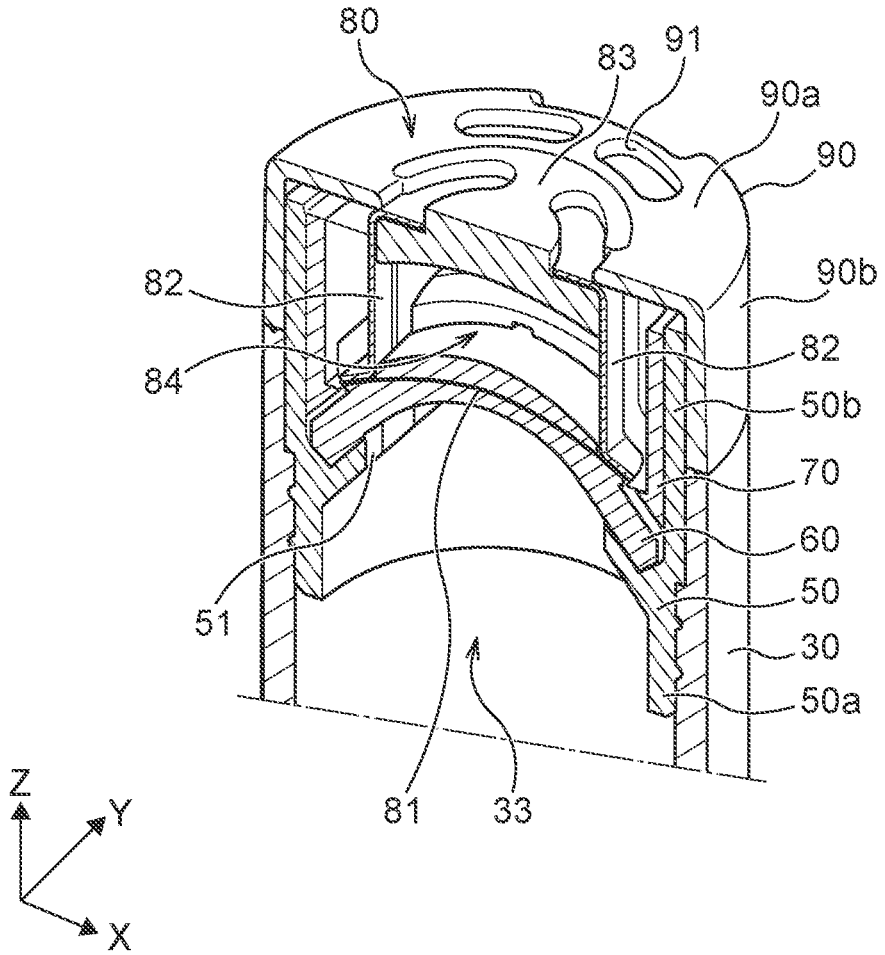
FIG. 7 is a sectional enlarged perspective view of a distal end side of the cartridge shown in FIG. 4.

The cartridge 20 illustrated in FIG. 1 will be now discussed. FIGS. 2 and 3 are perspective views of the cartridge 20. FIG. 4 is a sectional view of the cartridge 20 shown in FIG. 3 taken along an X-axis. FIG. 5 is a sectional view of the cartridge 20 shown in FIG. 3 taken along a Y-axis. FIG. 6 is a sectional view selectively showing a cartridge body of the cartridge shown in FIG. 5 taken along a VI-VI line as viewed in an arrow direction. FIG. 7 is a sectional enlarged perspective view of a distal end side of the cartridge 20 shown in FIG. 4. The configurations shown in the drawings may be partially omitted.

In FIGS. 2 to 5, the cartridge 20 includes a proximal end 21 and a distal end 22. The proximal end 21 is an end portion located close to the mouthpiece 11 shown in FIG. 1, that is, closer to the user's mouth than the distal end 22 while the inhalation device 10 is being used by the user. The distal end 22 is an end portion located close to the battery portion 12, that is, farther from the user's mouth than the proximal end 21 while the inhalation device 10 is being used by the user.

According to the present embodiment, for the sake of convenience, a direction connecting the proximal end 21 and the distal end 22, that is, a longitudinal direction of the cartridge 20 (vertical direction on FIGS. 2 to 5) is referred to as a Z-axis direction. One of two directions intersecting with the Z-axis direction, which is a direction in which a pair of electrodes 82 mentioned later is arranged (horizontal direction on FIG. 4), is referred to as an X-axis direction. The other of the two directions, which is a direction intersecting with both the Z- and Y-axis directions (horizontal direction on FIG. 5) is referred to as a Y-axis direction.

The cartridge 20 is provided with a substantially cylindrical cartridge body 30, a proximal end-side end wall 40, a liquid transporting member 60, an atomization unit 80, and a distal end-side end portion 90. The proximal end-side end wall 40 is a ring-like member with a center hole functioning as an aerosol outlet 41. The distal end-side end portion 90 is a cap-like member including an end wall 90*a* and a circumferential wall 90*b*. The cartridge 20 is further provided with a second retaining member 50 located on a proximal end 21 side of the liquid transporting member 60 and a first retaining member 70 located on a distal end 22 side of the liquid transporting member 60. The liquid transporting member 60 is therefore retained inside the cartridge 20 in a position held between the second retaining member 50 and the first retaining member 70. According to the present embodiment, the second retaining member 50 is disposed on the proximal end 21 side of the liquid transporting member 60, and the first retaining member 70 is disposed on the distal end 22 side of the liquid transporting member 60. However, this is not the only configuration of the first and second retaining members 70 and 50. The first retaining member 70 may be disposed on the proximal end 21 side of the liquid transporting member 60, and the second retaining member 50 may be disposed on the distal end 22 side of the liquid transporting member 60. Also, the second retaining member 50 and the first retaining member 70 may be disposed in a width direction so as to hold the liquid transporting member 60 therebetween. The width direction here means a direction intersecting with the longitudinal direction of the cartridge 20 (Z-axis direction).

As shown in FIGS. 5 and 6, the cartridge body 30 includes a cylindrical side wall (cylindrical housing) 31 and an inside wall 32 provided inside the cartridge body 30 and having an L-shaped longitudinal section. Inside the cartridge body 30, the inside wall 32 forms a liquid storage portion 33 that stores the liquid containing an aerosol producing material, and an aerosol channel 34 through which aerosol generated by the atomization unit 80 passes.

More specifically, the inside wall 32 includes a plate-like first wall portion 32*a* extending in the Z-axis direction and a second wall portion 32*b* extending from a proximal end 21-side end portion of the first wall portion 32*a* in the Y-axis direction. One of two main surfaces 35*a* of the first wall portion 32*a* and a distal end 22-side main surface of the second wall portion 32*b* form the liquid storage portion 33 in consort with a circumferentially extending portion of an inner peripheral surface of the side wall 31. The other main surface 35*b* of the first wall portion 32*a* forms the aerosol channel 34 in consort with a remaining circumferential portion of the inner peripheral surface of the side wall 31. In other words, inside the cartridge body 30, the aerosol channel 34 and the liquid storage portion 33 are adjacently disposed in the Y-axis direction, and the aerosol channel 34 and the liquid storage portion 33 are separated from each other by the first wall portion 32*a* and the second wall portion 32*b*.

The cartridge 20 according to the present embodiment may be an open tank that can be replenished with the liquid stored in the liquid storage portion 33 or a closed tank that cannot be replenished with the liquid stored in the liquid storage portion 33. The liquid stored in the liquid storage portion 33 may be infiltrated in fibrous material.

As shown in FIGS. 2 and 5, the proximal end-side end wall 40 is connected to a proximal end 21-side end portion of the side wall 31. Formed in the proximal end-side end wall 40 is the aerosol outlet 41 communicating with the aerosol channel 34. The aerosol generated by the atomization unit 80 passes through the aerosol channel 34 to be discharged outside the cartridge 20 from the aerosol outlet 41. If the inhalation device 10 is provided with the mouthpiece 11 as shown in FIG. 1, the aerosol discharged from the aerosol outlet 41 reaches the inside of the user's mouth through the mouthpiece 11. If the inhalation device 10 is not provided with the mouthpiece 11, the aerosol discharged from the aerosol outlet 41 directly reaches the inside of the user's mouth.

As shown in FIGS. 5 and 7, the second retaining member 50 includes a proximal end 21-side circumferential wall 50*a* that is fitted onto the inside of the side wall 31 and the inside wall 32, and a distal end 22-side circumferential wall 50*b* that is surrounded by a circumferential wall 90*b* of a distal end-side end portion 90 and abuts on an end wall 90*a* of the distal end-side end portion 90. The second retaining member 50 includes a second bottom surface facing an opposite surface to a main surface of the liquid transporting member 60, and a liquid supply hole 51 that is formed in the second bottom surface and supplies the liquid stored in the liquid storage portion 33 toward the liquid transporting member 60. The second retaining member 50 is disposed on a distal end 22 side of the liquid storage portion 33. The liquid supply hole 51 is formed in a surface of the second retaining member 50 which faces a proximal end 21-side surface of the liquid transporting member 60. The liquid supply hole 51 has a substantially rectangular shape. Long sides of the liquid supply hole 51 extend in the X-axis direction, and short sides in the Y-axis direction. A proximal end 21 side of the second retaining member 50 is fitted onto the inside of the side wall 31 and of the inside wall 32, whereby the liquid stored in the liquid storage portion 33 passes only through the liquid supply hole 51.

As shown in FIGS. 5 and 7, the liquid transporting member 60 is disposed on the distal end 22 side of the liquid storage portion 33 and of the second retaining member 50 so as to cover the liquid supply hole 51. A heater (heating element having an elongated shape) mentioned later is placed in a distal end 22-side surface of the liquid transporting member 60. The liquid transporting member 60 transports the liquid of the liquid storage portion 33 toward the heater. According to the present embodiment, therefore, the liquid storage portion 33, the liquid transporting member 60, and the heater are arranged in the longitudinal direction of the cartridge 20 (Z-axis direction on the drawings), and the liquid transporting member 60 also transports the liquid in the longitudinal direction of the cartridge 20 (Z-axis direction on the drawings). In the present embodiment, the arrangement direction of the liquid storage portion 33, the liquid transporting member 60, and the heater and the liquid transporting direction of the liquid transporting member 60 may be either parallel or intersect with the longitudinal direction of the cartridge 20 (Z-axis direction on the drawings).

The liquid transporting member 60 may have a function of transporting a liquid containing an aerosol producing material toward the heater. Specifically, the liquid transporting member 60 may be formed of any porous member that is configured to transport the liquid using a capillary force. The liquid transporting member 60 comes into tight contact with the heater and therefore is preferably formed of a flexible fibrous material, such as cotton and glass fiber. The liquid transporting member 60 may be formed of a plurality of porous members, for example, by forming cotton layers. The liquid transporting member 60 according to the present embodiment is a band-like cotton that is curved so that a center portion thereof protrudes toward the distal end 22 side.

As shown in FIGS. 5 and 7, the first retaining member 70 is disposed on the distal end 22 side of the liquid transporting member 60 and has an outer peripheral surface that is fit onto the inside of the distal end 22-side circumferential wall 50*b* of the second retaining member 50. The first retaining member 70 opens to expose a part of the liquid transporting member 60 toward the distal end 22. The liquid transporting member 60 is retained by the second retaining member 50 and the first retaining member 70.

As shown in FIG. 7, the atomization unit 80 includes a heater (heating element having an elongated shape) 81, a pair of electrodes 82, and an electrode retaining member 83. The electrodes 82 in a pair are arranged in a direction intersecting with the longitudinal direction of the cartridge 20 (Z-axis direction). For example, the electrodes 82 are arranged in the X-axis direction on the figure. The heater 81 is configured to heat and atomize the liquid transported by the liquid transporting member 60. The heater 81 according to the present embodiment is a single linear heater (linear element). The heater 81, however, may be a multi-linear heater or a mesh-like heater having an elongated shape as a whole.

The heater 81 is disposed in the distal end 22-side surface, namely, the main surface of the liquid transporting member 60. A chamber 84 is formed between the distal end 22-side surface of the liquid transporting member 60 and the electrode retaining member 83. The chamber 84 is a space for the heater 81 to atomize the liquid. The chamber 84 is in communication with the aerosol channel 34 shown in FIG. 5.

The heater 81 is provided in such a position as to overlap with the liquid supply hole 51 as viewed in the liquid transporting direction of the liquid transporting member 60 (Z-axis direction on the drawings). This makes it possible to preferentially supply the liquid to the vicinity of the heater 81 using the liquid transporting member 60 and thus improve an atomization efficiency. More preferably, the liquid supply hole 51 is provided over an area having a length equal to or greater than the entire length of the heater 81 in the X-axis direction (longitudinal direction) as viewed in the liquid transporting direction of the liquid transporting member 60 (Z-axis direction on the drawings). The entire length of the heater 81 thus extends over a portion of the liquid transporting member 60 which is sufficiently supplied with the liquid. This further improves the atomization efficiency.

As described above, the liquid transporting member 60 covers the liquid supply hole 51 with the proximal end 21-side surface thereof to seal the liquid storage portion 33 and supplies the liquid to the heater 81 through the distal end 22-side surface thereof. In this manner, the present embodiment is so configured that the liquid transporting member 60 functions to seal the liquid storage portion 33 and further functions to supply the liquid to the heater 81. This reduces the number of peripheral components of the liquid transporting member 60 and simplifies a peripheral structure of the liquid transporting member 60 and therefore that of the atomization unit 80.

The electrodes 82 in a pair are electrically and mechanically connected by spot welding or the like to respective ends of the heater 81. The electrodes 82 in a pair are positioned by the first retaining member 70 to fasten the heater 81 on the distal end 22-side surface of the liquid transporting member 60. The electrode retaining member 83 retains the pair of electrodes 82. The electrode retaining member 83 is configured to engage with a distal end 22-side end portion of the first retaining member 70. The electrodes 82 in a pair are configured to be connected to battery terminals, not shown, of the battery portion 12 when the cartridge 20 and the battery portion 12 of FIG. 1 are assembled together. This enables the battery portion 12 to supply electric power to the heater 81 through the pair of electrodes 82.

As shown in FIGS. 3 and 7, the distal end-side end portion 90 includes the circumferential wall 90*b* that is connected to a distal end 22-side end portion of the side wall 31. Formed in the distal end-side end portion 90 is an air inlet 91 communicating with the chamber 84. When the user inhales air from the mouthpiece 11, the air flows from the air inlet 91 into the chamber 84 as shown by an arrow in FIG. 5. The air then flows through the aerosol channel 34 while absorbing the aerosol generated in the chamber 84 by the heater 81 to reach the aerosol outlet 41.

The following is an example of an assembly procedure of the cartridge 20. First, the liquid transporting member 60 is disposed on the second retaining member 50. The liquid transporting member 60 is fastened after the first retaining member 70 is placed on the liquid transporting member 60. The second retaining member 50, the liquid transporting member 60, and the first retaining member 70 that are integrated together are inserted into the cartridge body 30 in which the liquid is stored. Next, the atomization unit 80 is disposed on the first retaining member 70, and the distal end-side end portion 90 is attached to a distal end 22 side of the cartridge body 30 to fasten the atomization unit 80. The proximal end-side end wall 40 is attached to a proximal end 21 side of the cartridge body 30. The foregoing assembly procedure may be carried out in no particular order.

For such an atomization assembly in which the heater 81 is disposed in the distal end 22-side surface of the liquid transporting member 60, an atomization efficiency is important to be improved by placing the liquid transporting member 60 and the heater 81 in an appropriate contact state. A contact state between the liquid transporting member 60 and the heater 81 according to the present embodiment will be discussed below with reference to FIGS. 7 to 9.

Figure 8:
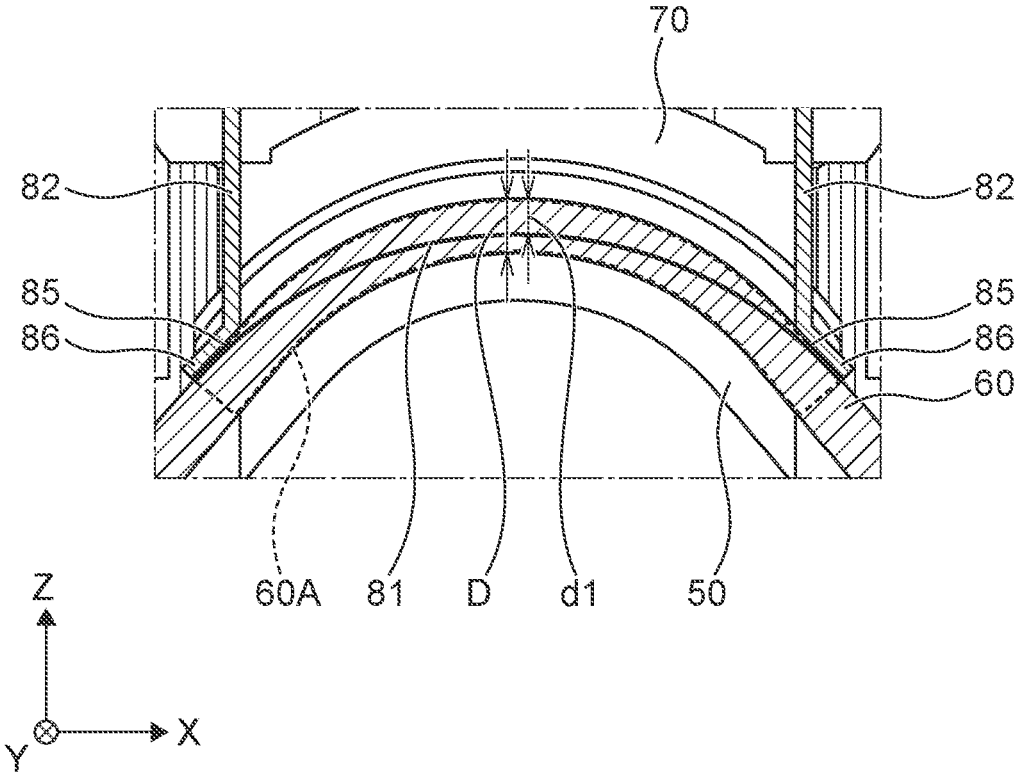
FIG. 8 is an enlarged view showing a contact state between a liquid transporting member and a heater in the cartridge.

FIG. 8 is an enlarged view showing the contact state between the liquid transporting member 60 and the heater 81 in the cartridge 20. FIG. 8 is an enlarged sectional view of a part of the distal end 22 side of the cartridge 20 shown in FIG. 4. In FIG. 8, the heater 81 is electrically and mechanically connected to the pair of electrodes 82 at electrical contact points 85 provided at both ends of the heater 81. The heater 81 is pressed against a distal end 22-side main surface of the liquid transporting member 60 in an opposite direction to the Z-axis direction. The heater 81 is thus at least partially pressed into the main surface of the liquid transporting member 60. A pressing depth at which the heater 81 is pressed into the liquid transporting member 60 is greater at a longitudinal center portion of the heater 81 than at each end portion of the heater 81. The pressing depth of the heater 81 is depth measured using a virtual continuous plane as a measurement basis which is sufficiently away from a point where the heater 81 starts being pressed in the main surface of the liquid transporting member 60 and includes an area that is not substantially deformed after the heater 81 is pressed into the liquid transporting member 60. The pressing depth of the heater 81, more specifically, is distance from the continuous plane to a central axis of the heater 81.

In a mode illustrated in FIG. 8, the linear heater 81 may have a shape of a curve that is gentler than a curve of an area in which the heater 81 extends in an extending direction of the band-like liquid transporting member 60 (X-axis direction on the figure), that is, a portion 60A in which the liquid transporting member 60 and the heater 81 are in contact with each other. Hereinafter, the portion 60A of the liquid transporting member 60 will be occasionally referred to as a heater contact portion. For example, if the heater 81 has a first curved shape, and the heater contact portion 60A of the liquid transporting member 60 has a second curved shape, a ratio of an arc to a chord of the first curved shape (heater 81) may be smaller than a ratio of an arc to a chord of the second curved shape (heater contact portion 60A). Length of the arc of the heater contact portion 60A is equal to length of the heater contact portion 60A along the proximal end 21-side surface of the liquid transporting member 60. Length of the chord of the heater contact portion 60A is equal to a virtual straight line connecting both end portions of the heater contact portion 60A in the proximal end 21-side surface of the liquid transporting member 60. A curvature at an apex of the first curved shape (heater 81) may be smaller than a curvature at an apex of the second curved shape (heater contact portion 60A). The curvature at the apex of the curved shape of the heater contact portion 60A is a curvature at an apex of a curved shape that is formed by the proximal end 21-side surface of the liquid transporting member 60. Typically speaking, the apex of the first curved shape corresponds to the center portion of the heater 81, and the apex of the second curved shape corresponds to a center portion of the heater contact portion 60A.

As described above, the heater 81 is pressed into the distal end 22-side surface of the liquid transporting member 60, and the pressing depth at which the heater 81 is pressed into the liquid transporting member 60 at the center portion of the heater 81 is set greater than the pressing depth at each end portion of the heater 81. Consequently, the center portion of the heater 81 which contributes much to the liquid atomization is positioned at a deeply dented spot in the main surface of the liquid transporting member 60. This reduces an effect an air flow along the main surface of the liquid transporting member 60 has on the heater 81, especially an effect the air flowing along the heater 81 has on the heater 81, that is, restrains a temperature decrease in the heater 81 which is caused by the aforementioned air flow. The atomization efficiency is therefore improved. A portion of the liquid transporting member 60 which comes into contact with the center portion of the heater 81 is pressed by the center portion of the heater 81 to be compressed in thickness direction. The porous member making up the liquid transporting member 60 is locally reduced in pore radius or void size. As a result, a speed at which the liquid is transported to the center portion of the heater 81 is locally increased, which improves the atomization efficiency.

According to the mode illustrated in FIG. 8, the liquid transporting member 60 has thickness (D) ranging, for example, from 0.5 mm to 2.0 mm, and preferably from 1.0 mm to 1.5 mm. A ratio of a maximum pressing depth (d1) of the heater 81 to the thickness (D) of the liquid transporting member 60 (d1/D) preferably, for example, ranges from 0.10 to 0.80. For example, if the thickness (D) of the liquid transporting member 60 is 1.0 mm, the maximum pressing depth (d1) of the heater 81 preferably ranges from 0.10 mm to 0.80 mm. The thickness (D) of the liquid transporting member 60 is thickness of the liquid transporting member 60 in a position retained by the second retaining member 50 and the first retaining member 70. The thickness (D) of the liquid transporting member 60 may be uniform over the entire length of the band-like liquid transporting member 60. The maximum pressing depth (d1) of the heater 81 is a maximum value of a depth of a groove that is formed when the heater 81 is pressed into the main surface of the liquid transporting member 60, and is typically a depth of a groove formed by the center portion of the heater 81. A contact state between the center portion of the heater 81 and the liquid transporting member 60 can be adjusted by changing the maximum pressing depth (d1) of the heater 81. Specifically, if the maximum pressing depth (d1) of the heater 81 is set within a predetermined range, the speed at which the liquid is transported to the center portion of the heater 81 can be optimized. The heater 81 has a diameter (d2) that may range, for example, from 0.060 mm to 0.15 mm.

The pair of electrodes 82 presses the heater 81 against the distal end 22-side surface of the liquid transporting member 60 at connections to the electrical contact points 85, to thereby press the heater 81 into the distal end 22-side surface of the liquid transporting member 60. The pair of electrodes 82 includes abutting portions 86 at the connections to the electrical contact points 85. The abutting portions 86 are inclined along the distal end 22-side surface of the liquid transporting member 60, that is, configured to make a surficial contact with the liquid transporting member 60. This allows the heater 81 to be pressed into the distal end 22-side surface of the liquid transporting member 60 in a stable manner. Furthermore, the abutting portions 86 of the pair of electrodes 86 contact the distal end 22-side surface of the liquid transporting member 60 without deforming the surface to a large degree, thereby restraining the liquid transporting member 60 from being locally broken or locally deteriorated in liquid retention capacity.

Figure 9:
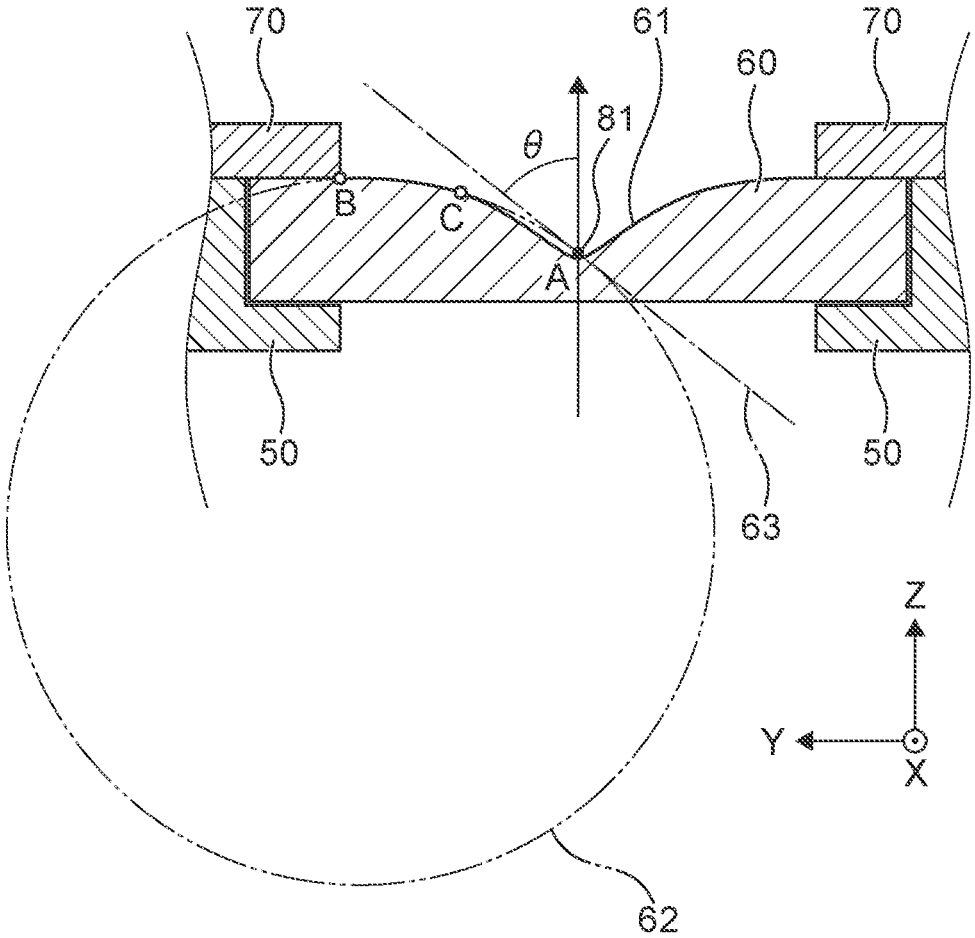
FIG. 9 is an enlarged view showing a contact state between the liquid transporting member and the heater in the cartridge.

FIG. 9 is an enlarged view showing the contact state between the liquid transporting member 60 and the heater 81 in the cartridge 20. FIG. 9 shows a cross-section of the cartridge 20 which is perpendicular to an arrangement direction of the electrical contact points (X-axis direction on the figure) sectioned at the longitudinal center portion of the heater 81. In FIG. 9, the heater 81 is a heating wire having a circular section and is electrically and mechanically connected to a pair of electrodes, not shown, at electrical contact points, not shown, provided at both ends of the heater 81 in an extending direction of the heater 81 (X-axis direction on the figure). The heater 81 is pressed in an opposite direction to the Z-axis direction against the distal end 22-side main surface of the liquid transporting member 60. A pressed-in portion 61 into which the heater 81 is pressed is thus formed in the main surface of the liquid transporting member 60. In the cross-section shown in FIG. 9, the pressed-in portion 61 of the liquid transporting member 60 has a shape like a tapered groove with a width that is gradually decreased in a pressed-in direction of the heater 81, that is, the opposite direction to the Z-axis direction. An inclination angle θ of the tapered groove to the pressed-in direction of the heater 81 preferably ranges from 55 degrees to 85 degrees, and more preferably from 65 degrees to 80 degrees.

The inclination angle θ of the tapered groove is defined as below. First, points A to C defined below are decided.

Point A: A center point of the heater 81, namely, the heating wire

Point B: A border point between a retained portion of the main surface of the liquid transporting member 60 which is retained by the first retaining member 70 and an exposed portion of the liquid transporting member 60

Point C: A point on the liquid transporting member 60 at a middle position between the point A and the point B in a direction (Y-axis direction on the drawings) perpendicular to the arrangement direction of the electrical contact points (X-axis direction on the drawings) and the pressed-in direction of the heater 81 (Z-axis direction on the drawings)

Next, a virtual circle 62 passing through the points A to C is created. The inclination angle θ of the tapered groove is an acuter one of two angles formed relative to the pressed-in direction of the heater 81 by a tangent line 63 extending through the point A on the virtual circle 62.

If the inclination angle θ of the tapered groove is set to 55 degrees or more, or preferably 65 degrees or more, to make the inclination of the tapered groove gentle to some extent, a liquid pool is restrained from being formed in a bottom portion of the tapered groove. This prevents the liquid from being excessively supplied to the center portion of the heater 81. If the inclination angle θ of the tapered groove is set to 85 degrees or less, or preferably 80 degrees or less, to make the inclination of the tapered groove sharp to some extent, contact area between an outer peripheral surface of the heater 81 and the main surface of the liquid transporting member 60 is increased. Consequently, exposure area of the outer peripheral surface of the heater 81 is reduced.

Figure 10:
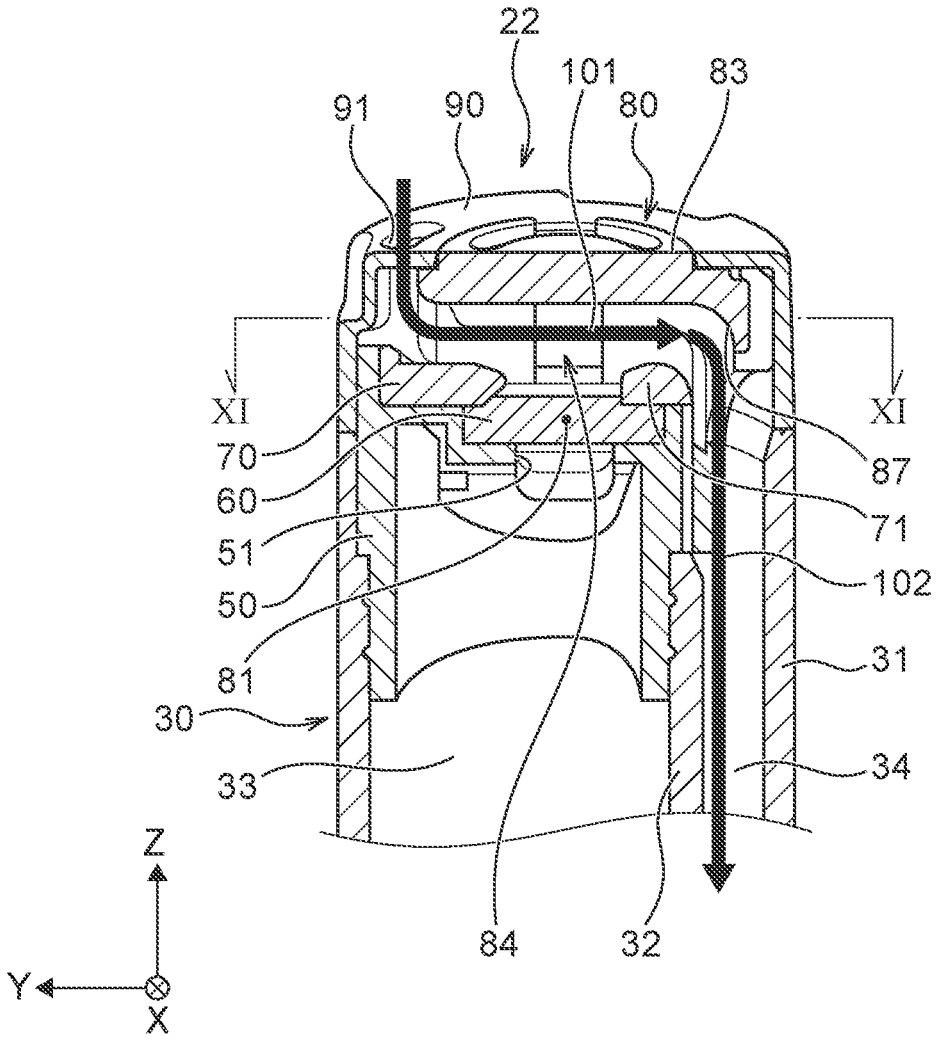
FIG. 10 is an enlarged perspective section of a distal end side of the cartridge shown in FIG. 5.
Figure 11:
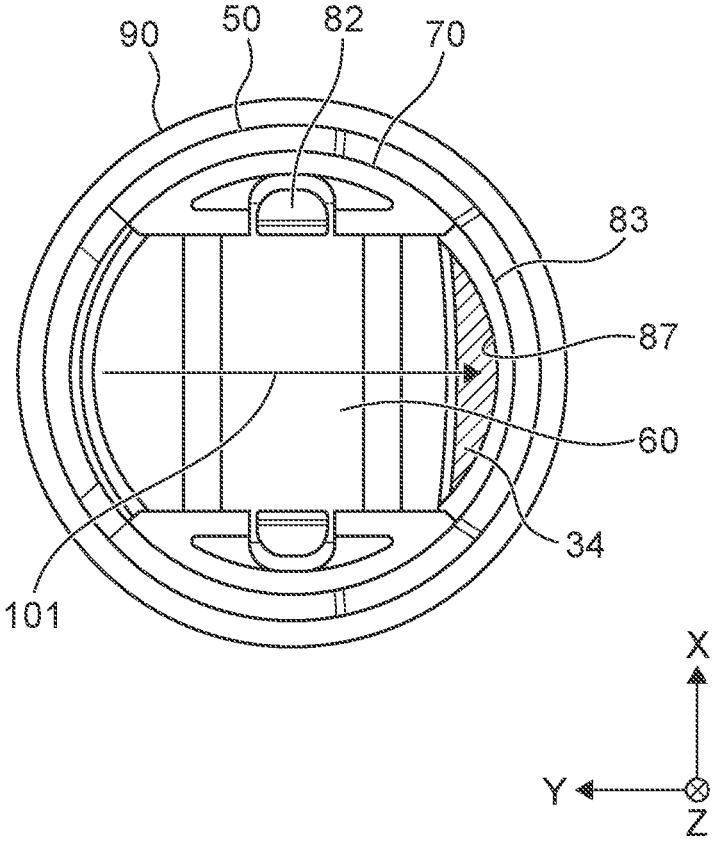
FIG. 11 is a sectional view of the cartridge shown in FIG. 10 taken along an XI-XI line as viewed in an arrow direction.

A fluid channel in the cartridge 20 according to the present embodiment, through which air and aerosol pass, will be discussed in detail with reference to FIGS. 10 and 11. FIG. 10 is an enlarged perspective section of a distal end 22 side of the cartridge 20 shown in FIG. 5. FIG. 11 is a sectional view of the cartridge 20 shown in FIG. 10 taken along an XI-XI line as viewed in an arrow direction.

In FIGS. 10 and 11, when the user inhales air from the mouthpiece 11 (see FIG. 1), the air enters the chamber 84 through the air inlet 91, and the air passes through the aerosol channel 34 while absorbing the aerosol generated by the heater 81 in the chamber 84, and aerosol is transferred through the aerosol channel 34 to a mouthpiece side of the inhalation device 10 as shown by arrows. This fluid channel includes a first channel 101 extending in the Y-axis direction and a second channel 102 extending in the Z-axis direction from a lower end portion of the first channel 101. The second channel 102 is equal or larger in dimension to or than the first channel 101 in the X-axis direction throughout the entire length. If the second channel 102 is set greater in width, or X-axis dimension, than the first channel 101, a contraction flow of the aerosol is restrained when and after the aerosol flows into the second channel 102 from the first channel 101. This prevents the aerosol from being condensed in the channel.

The first channel 101 is formed between the liquid transporting member 60 and the first retaining member 70 on one hand and the electrode retaining member 83 on the other. The first channel 101 extends across the arrangement direction of the pair of electrodes 82, that is, the arrangement direction of the electrical contact points, not shown. According to the present mode, the arrangement direction of the pair of electrodes 82 is parallel with the X-axis direction on the drawings. Since the first channel 101 extends across the heater 81 having the elongated shape as described, the heater 81 is prevented from being exposed to the air flow in the chamber 84 over the entire length thereof. This retains a temperature decrease in the heater 81 which is caused by the air flow and therefore improves the atomization efficiency.

The first retaining member 70 faces the distal end 22-side surface of the liquid transporting member 60 and has such a desired thickness that the retaining portion 71 retaining the liquid transporting member 60 separates the distal end 22-side surface of the liquid transporting member 60 from the first channel 101. Due to the first retaining member 70, therefore, the first channel 101 is disposed at a position away from the distal end 22-side surface of the liquid transporting member 60. Since the portion in which the liquid is atomized is located away from the first channel 101 in the Z-axis direction as mentioned, a temperature decrease in the heater 81 which is caused by the air flow in the chamber 84 is restrained, which improves the atomization efficiency.

The second channel 102 extends in a curve from the first channel 101 in the Z-axis direction. At the curve, the second channel 102 includes a curved inside wall 87 protruding in an extending direction of the first channel 101. The inside wall 87 has a curved shape in a Y-Z plane as shown in FIG. 10 and has a curved shape in an X-Y plane as shown in FIG. 11. Since the second channel 102 is formed into a shape of letter D protruding to a downstream side of the first channel 101, aerosol turbulence is restrained from occurring at both end portions in a width direction of the second channel 102, or in the X-axis direction, when fluid flows from the first channel 101 into the second channel 102. This prevents the aerosol from being condensed in the channel. The curved shape of the inside wall 87 of the second channel 102 extends along a circumferentially extending portion of the side wall (cylindrical housing) 31 (see FIG. 5) of the cartridge body 30. This restrains vortex generation at the curve of the channel and therefore further restrains the condensation of the aerosol.

According to the cartridge 20 thus configured, there are provided the liquid storage portion 33 configured to store liquid, the heater 81 configured to atomize the liquid, and the flexible liquid transporting member 60 configured to transport the liquid stored in the liquid storage portion 33 toward the heater 81. The heater 81 is the heater 81 having the elongate shape which includes the electrical contact points 85 at both ends thereof and is pressed into the main surface of the liquid transporting member 60. The heater 81 has a greater pressing depth at the center portion than at each end portion. This restrains a temperature decrease at the center portion of the heater 81 which is caused by the air flow and therefore improves the atomization efficiency.

The embodiments according to the invention have been discussed. The invention, however, does not necessarily have to be made in accordance with the above-described embodiments. The invention may be modified in various ways in a scope of the technical ideas discussed in the claims, specification and drawings. Any shape and material that provide the operation and advantageous effects of the invention fall in the scope of technical ideas of the invention even if no direct reference is made to such a shape and material in the description, claims and drawings.

Several modes disclosed in the present application will be described below.

A first mode provides an inhalation device cartridge comprising a liquid storage portion configured to store liquid, an atomizing portion configured to atomize the liquid, and a flexible liquid transporting member configured to transport the liquid stored in the liquid storage portion toward the atomizing portion. The atomizing portion is a heating element having an elongated shape which includes electrical contact points at both ends and is pressed into a main surface of the liquid transporting member. The pressing depth at a center portion of the heating element is greater than the pressing depth at each end portion of the heating element.

According to a second mode, the inhalation device cartridge of the first mode, the liquid transporting member has a porous structure.

According to a third mode, in the inhalation device cartridge of the first or second mode, the heating element is a linear body that is bent to have a first curved shape. The liquid transporting member is a band-like body that is bent to protrude in a similar direction as the heating element. The liquid transporting member has a second curved shape at a portion contacting the heating element that is the band-like body. A ratio of an arc to a chord of the first curved shape is smaller than a ratio of an arc to a chord of the second curved shape.

According to a fourth mode, in the inhalation device cartridge of the third mode, a curvature at an apex of the first curved shape is smaller than a curvature at an apex of the second curved shape.

According to a fifth mode, in the inhalation device cartridge of any one of the first to fourth modes, the inhalation device cartridge further comprises a first retaining member configured to retain the liquid transporting member with the main surface of the liquid transporting member partially exposed. The first retaining member forms a fluid channel at a position away from the main surface.

According to a sixth mode, in the inhalation device cartridge of the fifth mode, the heating element is a heating wire having a circular section. The heating wire is pressed into the main surface of the liquid transporting member to form a pressed-in portion in the main surface of the liquid transporting member. The pressed-in portion of the liquid transporting member has a shape like a tapered groove with width decreasing in a pressed-in direction of the heating wire in a cross-section of the inhalation device cartridge which is perpendicular to an arrangement direction of the electrical contact points, taken at a center portion of the wire. An inclination angle θ of the tapered groove to the pressed-in direction of the heating wire ranges from 55 degrees to 85 degrees. The inclination angle θ is an acuter one of two angles formed relative to the pressed-in direction of the heating wire by a tangent line extending through a center point of the heating wire on a virtual circle passing through (i) the center point of the heating wire, (ii) a border point between a retained portion of the main surface of the liquid transporting member which is retained by the first retaining member and an exposed portion of the liquid transporting member, and (iii) a point on the liquid transporting member at a middle position between the center point and the border point in a direction perpendicular to the arrangement direction of the electrical contact points and the pressed-in direction of the heating wire.

According to a seventh mode, in the inhalation device cartridge of any one of the first to sixth modes, the inhalation device cartridge further comprises a pair of electrodes connected to both the ends of the heating element and connecting the electrical contact points and a power source. The pair of electrodes presses the heating element against the main surface of the liquid transporting member at connections to the electrical contact points.

According to an eighth mode, in the inhalation device cartridge of the seventh mode, the liquid transporting member includes the main surface that is curved into a shape of a curved surface. The pair of electrodes includes abutting portions inclined along the main surface at the connections to the electrical contact points.

According to a ninth mode, in the inhalation device cartridge of any one of the first to eighth modes, the inhalation device cartridge further comprises a fluid channel extending across the arrangement direction of the electrical contact points of the heating element.

According to a 10th mode, in the inhalation device cartridge of any one of the first to ninth modes, the inhalation device cartridge further comprises an aerosol channel configured to transfer aerosol generated in the heating element toward a mouthpiece. The aerosol channel includes a first channel extending in a direction intersecting with the arrangement direction of the electrical contact points of the heating element and the pressed-in direction of the heating element, and a second channel extending from a downstream end of the first channel along the pressed-in direction of the heating element. The second channel is equal or larger in dimension to or than the first channel throughout the entire length in the arrangement direction of the electrical contact points.

According to an 11th mode, in the inhalation device cartridge of the 10th mode, the second channel includes an inside wall having a curved shape which protrudes in an extending direction of the first channel.

According to a 12th mode, in the inhalation device cartridge of the 11th mode, the inhalation device cartridge further comprises a cylindrical housing extending along the second channel. The curved shape of the inside wall of the second channel extends along a circumferentially extending portion of the cylindrical housing.

According to a 13th mode, in the inhalation device cartridge of any one of the first to 12th modes, the inhalation device cartridge further comprises a second retaining member configured to retain the liquid transporting member. The second retaining member includes a second bottom portion facing an opposite surface to the main surface of the liquid transporting member, and a liquid supply hole formed in the second bottom portion and configured to supply the liquid stored in the liquid storage portion toward the liquid transporting member.

According to a 14th mode, in the inhalation device cartridge of the 13th mode, the heating element is provided in such a position as to overlap with the liquid supply hole as viewed in the liquid transporting direction of the liquid transporting member.

According to a 15th mode, the inhalation device cartridge of the 13 or 14 mode, the liquid supply hole is provided over an area having a length equal to or greater than an entire longitudinal length of the heating element as viewed in the liquid transporting direction of the liquid transporting member.

A 16th mode provides an inhalation device comprising the inhalation device cartridge of any one of the first to 15th modes.

According to a 17th mode, an inhalation device comprising a liquid storage portion configured to store liquid, an atomizing portion configured to atomize the liquid, and a flexible liquid transporting member configured to transfer the liquid stored in the liquid storage portion toward the atomizing portion. The atomizing portion is a heating element having an elongated shape which includes electrical contact points at both ends, the heating element being pressed into the main surface of the liquid transporting member. The pressing depth at a center portion of the heating element is greater than the pressing depth at each end portion of the heating element.

REFERENCE SIGN LIST

10: Inhalation device
11: Mouthpiece
12: Battery portion
20: Cartridge
21: Proximal end
22: Distal end
30: Cartridge body
31: Side wall
32: Inside wall
32*a*: First wall portion
32*b*: Second wall portion
33: Liquid storage portion
34: Aerosol channel
35*a*: Main surface
35*b*: Main surface
40: Proximal end-side end wall
41: Aerosol outlet
50: Second retaining member
50*a*: Circumferential wall
50*b*: Circumferential wall
51: Liquid supply hole
60: Liquid transporting member
60A: Heater contact portion
61: Pressed-in portion
62: Virtual circle
63: Tangent line
70: First retaining member
71: Retaining portion
80: Atomization unit
81: Heater
82: Electrode
83: Electrode retaining member
84: Chamber
85: Electrical contact point
86: Abutting portion
87: Inside wall
90: Distal end-side end portion
90*a*: End wall
90*b*: Circumferential wall
91: Air inlet
101: First channel
102: Second channel

The invention claimed is:

1. An inhalation device cartridge comprising:
a liquid storage portion configured to store liquid;
an atomizing portion configured to atomize the liquid; and
a flexible liquid transporting member configured to transport the liquid stored in the liquid storage portion toward the atomizing portion,
the atomizing portion being a heating element having an elongated shape which includes electrical contact points at both ends and is pressed into a main surface of the liquid transporting member, and
the pressing depth at a center portion of the heating element being greater than the pressing depth at each end portion of the heating element,
wherein the heating element is a linear body that is bent to have a first curved shape,
wherein the liquid transporting member is a band-like body that is bent to protrude in a similar direction as the heating element, the liquid transporting member having a second curved shape at a portion contacting the heating element that is the band-like body, and
wherein a ratio of an arc to a chord of the first curved shape is smaller than a ratio of an arc to a chord of the second curved shape.

2. The inhalation device cartridge according to claim 1, wherein the liquid transporting member has a porous structure.

3. The inhalation device cartridge according to claim 1, wherein a curvature at an apex of the first curved shape is smaller than a curvature at an apex of the second curved shape.

4. The inhalation device cartridge according to claim 1, further comprising a first retaining member configured to retain the liquid transporting member with the main surface of the liquid transporting member partially exposed, and
wherein the first retaining member forms a fluid channel at a position away from the main surface.

5. The inhalation device cartridge according to claim 4, wherein the heating element is a heating wire having a circular section,
wherein the heating wire is pressed into the main surface of the liquid transporting member to form a pressed-in portion in the main surface of the liquid transporting member,
wherein the pressed-in portion of the liquid transporting member has a shape like a tapered groove with width decreasing in a pressed-in direction of the heating wire in a cross-section of the inhalation device cartridge which is perpendicular to an arrangement direction of the electrical contact points, taken at a center portion of the wire, and an inclination angle θ of the tapered groove to the pressed-in direction of the heating wire ranges from 55 degrees to 85 degrees, and
wherein the inclination angle θ is an acuter one of two angles formed relative to the pressed-in direction of the heating wire by a tangent line extending through a center point of the heating wire on a virtual circle passing through (i) the center point of the heating wire, (ii) a border point between a retained portion of the main surface of the liquid transporting member which is retained by the first retaining member and an exposed portion of the liquid transporting member, and (iii) a point on the liquid transporting member at a middle position between the center point and the border point in a direction perpendicular to the arrangement direction of the electrical contact points and the pressed-in direction of the heating wire.

6. The inhalation device cartridge according to claim 1, further comprising:

a pair of electrodes connected to both the ends of the heating element and connecting the electrical contact points and a power source, wherein the pair of electrodes presses the heating element against the main surface of the liquid transporting member at connections to the electrical contact points.

7. The inhalation device cartridge according to claim 6, wherein the liquid transporting member includes the main surface that is curved into a shape of a curved surface, and wherein the pair of electrodes includes abutting portions inclined along the main surface at the connections to the electrical contact points.

8. The inhalation device cartridge according to claim 1, further comprising a fluid channel extending across the arrangement direction of the electrical contact points of the heating element.

9. The inhalation device cartridge according to claim 1, further comprising an aerosol channel configured to transfer aerosol generated in the heating element toward a mouthpiece, wherein the aerosol channel includes a first channel extending in a direction intersecting with the arrangement direction of the electrical contact points of the heating element and the pressed-in direction of the heating element, and a second channel extending from a downstream end of the first channel along the pressed-in direction of the heating element, and wherein the second channel is equal or larger in dimension to or than the first channel throughout the entire length in the arrangement direction of the electrical contact points.

10. The inhalation device cartridge according to claim 9, wherein the second channel includes an inside wall having a curved shape which protrudes in an extending direction of the first channel.

11. The inhalation device cartridge according to claim 10, further comprising a cylindrical housing extending along the second channel, wherein the curved shape of the inside wall of the second channel extends along a circumferentially extending portion of the cylindrical housing.

12. The inhalation device cartridge according to claim 1, further comprising a second retaining member configured to retain the liquid transporting member, wherein the second retaining member includes a second bottom portion facing an opposite surface to the main surface of the liquid transporting member, and a liquid supply hole formed in the second bottom portion and configured to supply the liquid stored in the liquid storage portion toward the liquid transporting member.

13. The inhalation device cartridge according to claim 12, wherein the heating element is provided in such a position as to overlap with the liquid supply hole as viewed in the liquid transporting direction of the liquid transporting member.

14. The inhalation device cartridge according to claim 12, wherein the liquid supply hole is provided over an area having a length equal to or greater than an entire longitudinal length of the heating element as viewed in the liquid transporting direction of the liquid transporting member.

15. The inhalation device cartridge according to claim 1, wherein the flexible liquid transporting member includes a first surface facing the liquid storage portion, and a second surface opposite to the first surface, and wherein a minimum distance between the center portion of the heating element and the second surface of the flexible liquid transporting member is greater than a minimum distance between each of the end portions of the heating element and the second surface of the flexible liquid transporting member.

16. An inhalation device comprising the inhalation device cartridge according to claim 1.

17. An inhalation device comprising:

a liquid storage portion configured to store liquid;

an atomizing portion configured to atomize the liquid; and a flexible liquid transporting member configured to transfer the liquid stored in the liquid storage portion toward the atomizing portion, the atomizing portion being a heating element having an elongated shape which includes electrical contact points at both ends and is pressed into the main surface of the liquid transporting member, and the pressing depth at a center portion of the heating element being greater than the pressing depth at each end portion of the heating element, wherein the heating element is a linear body that is bent to have a first curved shape, wherein the liquid transporting member is a band-like body that is bent to protrude in a similar direction as the heating element, the liquid transporting member having a second curved shape at a portion contacting the heating element that is the band-like body, and wherein a ratio of an arc to a chord of the first curved shape is smaller than a ratio of an arc to a chord of the second curved shape.

* * * * *